US010383387B2

(12) United States Patent
Gendron et al.

(10) Patent No.: US 10,383,387 B2
(45) Date of Patent: Aug. 20, 2019

(54) APPARATUS AND METHODS FOR SECURING ACCESSORIES TO A HELMET

(71) Applicant: Revision Military S.a.r.L., Luxembourg (LU)

(72) Inventors: Marie-Pierre Gendron, Mercier (CA); Stéphane Lebel, St. Redempteur (CA)

(73) Assignee: Revision Military S.a.r.L., Luxembourg (LU)

( * ) Notice: Subject to any disclaimer, the term of this patent is extended or adjusted under 35 U.S.C. 154(b) by 0 days.

(21) Appl. No.: 14/301,302

(22) Filed: Jun. 10, 2014

(65) Prior Publication Data

US 2015/0351482 A1 Dec. 10, 2015

(51) Int. Cl.
*A42B 3/04* (2006.01)
*A42B 3/30* (2006.01)

(52) U.S. Cl.
CPC ..... *A42B 3/30* (2013.01); *A42B 3/04* (2013.01); *A42B 3/042* (2013.01); *A42B 3/044* (2013.01)

(58) Field of Classification Search
CPC .. F41H 1/04; Y10T 24/1394; Y10T 24/44598; Y10T 24/44974; A42B 3/16; A42B 3/163; A42B 3/166; A42B 3/20; A42B 3/30; A42B 3/303; A42B 3/306; A42B 3/04; A42B 3/0406; A42B 3/042; A42B 3/0426; A42B 3/044; A42B 3/22; A42B 3/221; A42B 3/222; A42B 3/223; A42B 3/228; A42B 3/18; A42B 3/185
USPC ..... 2/6.2, 422, 421, 6.3, 6.4, 6.5, 6.6, 6.7, 2/410; 362/105, 106
See application file for complete search history.

(56) References Cited

U.S. PATENT DOCUMENTS 2,879,969 A * 3/1959 Bamberger ..... F16B 5/06 24/569
3,013,320 A * 12/1961 Miller ..... A42B 3/04 24/569
3,193,841 A * 7/1965 Haluska ..... A42B 3/166 2/209
5,658,065 A 8/1997 Jamieson
(Continued)

OTHER PUBLICATIONS

Invitation to Pay Additional Fees for PCT/IB2015/001612 dated Nov. 25, 2015.

(Continued)

*Primary Examiner* — Anna K Kinsaul
*Assistant Examiner* — F Griffin Hall
(74) *Attorney, Agent, or Firm* — Wolf, Greenfield & Sacks, P.C.

(57) ABSTRACT

Attachment systems for attaching accessories to a helmet shell and their methods of use are described. In one embodiment, an attachment system may include a first attachment portion mounted to a helmet shell and extending through an opening in an associated accessory. The attachment system also may include a second attachment portion that is selectively connectable to the first attachment portion. A surface of the second attachment portion facing the helmet shell engages with a bearing surface of the accessory to selectively attach the accessory to the helmet shell. In certain embodiments, the first and second attachment portions may be selectively connected to one another using a connector that moves the second attachment portion both vertically and horizontally relative to the first attachment portion when the connector is tightened.

32 Claims, 3 Drawing Sheets

(56) References Cited

U.S. PATENT DOCUMENTS 6,079,053 A * 6/2000 Clover, Jr. ..... A42B 3/20 2/424
6,820,285 B2 * 11/2004 Bataille ..... A42B 3/042 2/422
7,219,370 B1 * 5/2007 Teetzel ..... A42B 3/04 2/422
7,386,922 B1 * 6/2008 Taylor ..... E04D 13/10 24/525
7,517,108 B2 * 4/2009 Galli ..... F21V 21/084 362/110
7,849,517 B2 12/2010 Rogers et al.
7,908,667 B2 3/2011 Rogers et al.
8,028,344 B2 10/2011 Rogers et al.
8,214,920 B1 7/2012 Edgar et al.
8,375,473 B2 * 2/2013 Celona ..... A42B 3/04 2/422
2005/0254238 A1 * 11/2005 Parker ..... A42B 3/044 362/191
2007/0250992 A1 * 11/2007 Brown ..... A42B 3/20 2/424
2008/0263752 A1 * 10/2008 Solinsky ..... A42B 3/042 2/422
2009/0077721 A1 * 3/2009 Prendergast ..... F41H 1/08 2/422
2009/0222978 A1 * 9/2009 Fang ..... A42B 3/085 2/421
2010/0012692 A1 * 1/2010 Harris ..... A42B 3/185 224/181
2010/0083413 A1 * 4/2010 McGovern ..... A42B 3/04 2/6.6
2010/0175172 A1 * 7/2010 Dempsey ..... A42B 3/042 2/422
2010/0251464 A1 * 10/2010 Parisi ..... A42B 3/20 2/424
2010/0301779 A1 12/2010 Spartano et al.
2011/0113519 A1 * 5/2011 Gendron ..... G02C 3/02 2/2.5
2011/0145981 A1 * 6/2011 Teetzel ..... A42B 3/04 2/422
2011/0188236 A1 8/2011 Eichelberger et al.
2011/0214224 A1 * 9/2011 Maddux ..... A42B 3/20 2/424
2011/0239354 A1 * 10/2011 Celona ..... A42B 3/04 2/422
2012/0090079 A1 * 4/2012 Lebel ..... A42B 3/185 2/422
2012/0117717 A1 * 5/2012 McGinn ..... A42B 3/04 2/424
2012/0317706 A1 * 12/2012 Lebel ..... F41H 1/08 2/422
2013/0086722 A1 * 4/2013 Teetzel ..... F41H 1/04 2/2.5
2013/0291290 A1 11/2013 Bernier et al.
2014/0000013 A1 * 1/2014 Redpath ..... A42B 3/04 2/422
2014/0020159 A1 * 1/2014 Teetzel ..... A42B 3/0406 2/422
2014/0033406 A1 2/2014 Lebel et al.
2014/0130241 A1 * 5/2014 Abdollahi ..... A42B 3/042 2/422
2014/0189938 A1 * 7/2014 Redpath ..... A42B 3/04 2/422

OTHER PUBLICATIONS

International Search Report and Written Opinion for PCT/IB2015/001612 dated Feb. 2, 2016.

* cited by examiner

APPARATUS AND METHODS FOR SECURING ACCESSORIES TO A HELMET

FIELD

Embodiments are related to helmet accessory attachment systems.

BACKGROUND

Those who are at risk of exposure to trauma to the head (e.g., soldiers, emergency responders, law enforcement officers, military personnel, etc.) may wear protective headgear, such as a helmet. In some cases, it may be desirable for helmets to include an accessory, such as a carrier, front mount, rail mount, illuminator, camera, video recorder, laser pointer, communications device, identification friend or foe (IFF) device, or other item, to aid the helmet wearer in the performance of duties while in the field.

SUMMARY

In one embodiment, an attachment system includes a first attachment portion constructed and arranged to be mounted to a helmet shell. The first attachment portion is also constructed and arranged to extend through an opening in an accessory. A second attachment portion is selectively connectable to the first attachment portion. A surface of the second attachment portion that faces the helmet shell is constructed and arranged to engage a bearing surface of the accessory to selectively attach the accessory to the helmet shell when the second attachment portion is connected to the first attachment portion.

In another embodiment, an attachment system includes a first attachment portion constructed and arranged to be mounted to a helmet shell as well as a second attachment portion. The attachment system also includes a connector constructed and arranged to selectively connect the second attachment portion to the first attachment portion. When the connector is tightened, the second attachment portion is moved both vertically and horizontally relative to the first attachment portion to engage a bearing surface of an accessory to selectively attach the accessory to the helmet shell when the second attachment portion is connected to the first attachment portion.

In a further embodiment, a method of attaching an accessory to a helmet includes: positioning an opening of an accessory around a first attachment portion of an attachment system that is mounted to a helmet shell surface; and connecting a second attachment portion of the attachment system to the first attachment portion to engage a surface of the second attachment portion facing the helmet shell with a bearing surface of the accessory to attach the accessory to the helmet when the second attachment portion is connected to the first attachment portion.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
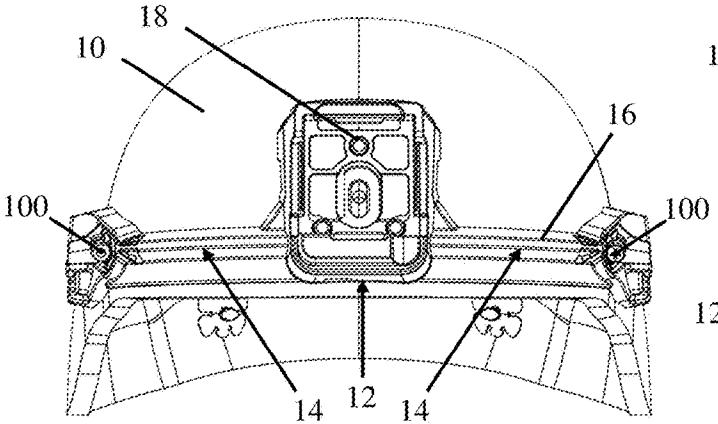
FIG. 1 is a schematic front view of a helmet shell and attachment system according to one embodiment.

The inventors have recognized that it may be desirable to reduce and/or eliminate the presence of bolt holes within a helmet shell to improve the ballistic performance of a helmet. Additionally, the inventors have recognized that the same bolt is sometimes used to attach both accessories and attachment systems to the helmet shell. For example, a carrier such as a front rail or front mount may share one or more retention bolts with a helmet retention system (i.e. helmet straps) and/or another accessory or attachment. Consequently, when the one or more bolts used to retain any one of these systems is loosened to adjust or remove a specific accessory or attachment, the bolt is loosened for all of the other accessories and attachments. The inventors have recognized that it may be desirable to provide a separate attachment system that does not use the same bolt or attachment system that is used for other accessories or attachments.

In view of the above, the inventors have recognized the benefits associated with an attachment system including a first attachment portion mounted to a helmet shell which cooperates with a second attachment portion to attach a desired accessory to a helmet shell. The second attachment portion may cooperate with the first attachment portion in any suitable fashion such that it locks, compresses, or otherwise captures a corresponding portion of an accessory to attach the accessory to the helmet shell. In one specific embodiment, the second attachment portion may capture, or be compressed against, a bearing surface of the accessory such that the bearing surface of the accessory is located between the second attachment portion and the helmet shell. It should be understood that the accessory may correspond to any suitable device or structure that a user may wish to attach to a helmet shell. For example, the accessory may be one or more of a carrier (e.g., a front mount, a front rail, or other carrier), a rail mount, night vision goggles, a battery pack, a display, an illuminator, a camera, a video recorder, a laser pointer, a communications device, an identification friend or foe (IFF) device, as well as any other suitable types of electronic and mechanical accessories.

In one embodiment, an attachment system includes a first attachment portion that is mounted to a helmet shell. For example, the first attachment portion may include a base that conforms to a shape of a helmet shell to be mounted flush there against. However, embodiments in which a base of the first attachment portion does not conform to a shape of the helmet shell are also contemplated. The first attachment portion may be mounted to the helmet shell in any suitable fashion. For example, the first attachment portion may be attached to the helmet shell using adhesives, threaded connectors such as bolts, thermal attachment methods (e.g. ultrasonic welding, thermal welding, etc.), or any other suitable method of mounting the first attachment portion to the helmet shell. In instances where an adhesive is used, suitable adhesives include, but are not limited to, epoxies, acrylic adhesives, cyanoacrylates, hot melt adhesives, and/or any other suitable adhesive as the disclosure is not so limited. To increase the bonding strength between the first attachment portion and the helmet shell, in some embodiments, it may be desirable to apply the adhesive and bond the first attachment portion to the helmet shell prior to painting.

As noted above, in some embodiments, an attachment system includes a second attachment portion that is selectively connectable to the first attachment portion. In such an embodiment, a lower surface of the second attachment portion that faces the helmet shell engages a bearing surface of the accessory when the second attachment portion is attached to the first attachment portion. This engagement between the lower surface of the second attachment portion and the bearing surface of the accessory secures the accessory to the attachment system. The second attachment portion is selectively connected to the first attachment portion in any suitable manner. Suitable connectors that may be used to selectively connect the first and second attachment portions include, but are not limited to, pins and clips, threaded connectors (e.g. bolts, screws, etc.), quick compression connectors, mechanical interferences, latches, mechanical interlocking features, quarter-turn connectors, or any other suitable method of providing a connection.

Depending on the particular embodiment, tightening of a connector may move a second attachment portion in one or more directions relative to an associated helmet shell and/or first attachment portion to engage a surface of the second attachment portion with a bearing surface of an associated accessory. For example, in one embodiment, tightening of the connector moves the second attachment portion in a horizontal direction relative to the helmet shell and/or first attachment portion. Alternatively, in another embodiment, tightening of the connector moves the second attachment portion in a vertical direction relative to the helmet shell and/or first attachment portion. In yet another embodiment, tightening of the connector moves the second attachment portion in both the vertical and horizontal directions relative to the helmet shell and/or first attachment portion. For purposes herein, vertical movement refers to movement in a direction either toward or away from an element, and horizontal movement refers to movement in a direction along or substantially parallel to the element. In this respect, for purposes herein, horizontal movement does not require either a straight line movement or movement in a direction perpendicular to gravity. Similarly, for purposes herein, vertical movement does not require straight line movement or movement in a direction in line with gravity. Further, movement of a feature in a direction that is angled relative to an element is considered to be moving the feature in both the vertical and horizontal directions because the angled movement has both vertical and horizontal vector components. For example, movement of an attachment portion toward a helmet shell surface includes a vertical movement component, while movement of an attachment portion substantially parallel to a helmet shell surface includes a horizontal movement component.

While the above noted movements may be provided in any number of ways, in one embodiment, movement of the second attachment portion in multiple directions is provided using a connector, such as a threaded connector, having an axis that is angled relative to an associated helmet shell as well as the first and/or second attachment portions. When the connector is tightened, the second attachment portion moves along the angled axis of the connector, thereby moving the second attachment portion in both the vertical and horizontal directions relative to the associated helmet shell and/or first attachment portion. However, it should be understood that other arrangements capable of moving a second attachment portion in multiple directions are also contemplated including, for example, mechanical interlocking features, latches, and cams, to name a few.

As noted above, in one embodiment, a bearing surface of an accessory engages with a corresponding surface of a second attachment portion. The bearing surface and the corresponding surface of the second attachment portion may have any suitable corresponding shapes and sizes. For example, the bearing surface and/or corresponding surface of the second attachment portion may be an elongated oval, a circle, a square, a rectangle, an oblong shape, or any other suitable shape as the disclosure is not so limited. Because the surface of the second attachment portion is supported on the bearing surface, the corresponding surface of the second attachment portion has an area that is less than or equal to an area of the bearing surface, in some embodiments. Additionally, in embodiments where the second attachment portion is moved in a horizontal direction relative to the first attachment portion and/or helmet shell, the bearing surface may be elongated to accommodate horizontal movement of the second attachment portion relative to the helmet shell and/or first attachment portion during connection.

In some embodiments, a first attachment portion that is mounted to a helmet shell is constructed so that it extends through an opening in an accessory. The opening may either extend partially around the first attachment portion, or the opening may extend completely around the first attachment portion as the disclosure is not so limited. Additionally, in some embodiments, a bearing surface of the accessory extends either partially, or completely around, the opening. However, embodiments in which the bearing surface is located separate from the opening are also contemplated. The opening also may have any suitable shape and may be sized according to various design criteria. For example, the opening may be an open-ended U shape, an elongated oval, a circle, a square, a rectangle, or any other suitable shape. In one embodiment, the opening interacts with the first attachment portion, or a separate locking feature, to help prevent movement of the accessory when attached to a helmet shell. For example, the opening, or a portion of the opening, may have a shape and size that substantially conforms to a shape and size of the first attachment portion and/or locking feature. However, it should be understood that embodiments in which the opening does not match a shape and size of another feature of the attachment system are also contemplated. In instances where a separate locking feature is used, the locking feature may be associated with the first attachment portion, second attachment portion, or some other suitable component of the attachment system.

In some embodiments, a helmet accessory is attached to a helmet shell by first positioning an opening of the accessory in a desired location relative to a first attachment portion mounted to the helmet shell. For example, the first attachment portion may be positioned within and extend at least partially through the opening of the accessory. A second attachment portion is then connected to the first attachment portion. While connected, a surface of the second attachment portion facing the helmet shell engages a bearing surface of the accessory to attach the accessory to the helmet shell. Depending on the particular embodiment, the second attachment portion may apply a normal force to the bearing surface to retain the accessory on the helmet shell. In such an embodiment, friction between the helmet shell and the accessory may help to maintain the accessory in a desired location. Alternatively, the second attachment portion may simply be located flush against the bearing surface, thus preventing the accessory from being removed from the helmet shell. In such an embodiment, other features may be used to help maintain the accessory in the desired location on the helmet shell.

Depending on the particular application, it may be desirable to provide an increased retention force for mounting the first attachment portion to a helmet shell to improve fatigue life, increase total force to failure of the attachment system, and/or increase the weight of an approved attached accessory. It should be understood that an increased retention force may be provided in any number of manners. For example, in embodiments where an adhesive is used to mount the first attachment portion to the helmet shell, the increased retention force may be provided by using a first attachment portion that protrudes from a base that has a larger surface area in contact with the helmet shell. The base may have a lower surface that both faces and conforms to a shape of the helmet shell. Because the base may have any desired size, an area of the base may be selected to provide a desired retention force by using the desired retention force and the bonding strength of the particular attachment method being used. It should be apparent from the above that the base may either have an area that is equal to, or greater than, an area of the first attachment portion.

In some instances, it is desirable to increase the attachment force associated with an attached accessory. In some embodiments, an increased attachment force is provided with an increased surface area between a surface of the second attachment portion and a corresponding bearing surface of the accessory. While it may be possible to enlarge the bearing surface area and the second attachment portion, in some embodiments, it may be desirable to limit a size of the second attachment portion to prevent interference with other components attached to the helmet shell. In such an embodiment, wings, or other suitable features extending from a bottom section of the second attachment portion adjacent to the bearing surface may provide the increased surface area while maintaining a size of the remaining sections of the second attachment portion.

It should be understood that the various components of the attachment system, as well as the corresponding portions of the accessory, may be made from any suitable material. For example, polymers, metals, and/or ceramics may be used. In addition to the above, a combination of polymers, metals, and/or ceramics may be used for the various components of the attachment system and corresponding accessory as the disclosure is not limited in this fashion.

Turning now to the figures, several non-limiting embodiments are described in further detail. It should be understood that the various features and components described in regards to the figures may be arranged in any desired combination and that the current disclosure is not limited to only those embodiments depicted in the figures. Further, for the sake of clarity, a front mount connected to a helmet shell using an associated carrier is described as an example of an accessory with regard to the figures. However, it should be understood that the described attachment systems may be used with any suitable accessory as the disclosure is not limited in this fashion.

Figure 2:
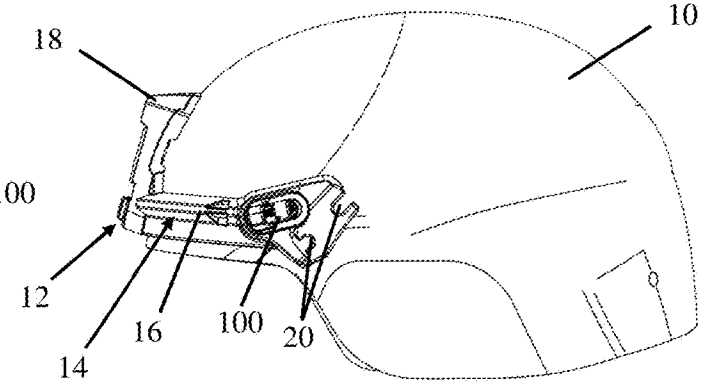
FIG. 2 is a schematic side view of the helmet shell and attachment system according to the embodiment of FIG. 1.
Figure 3:
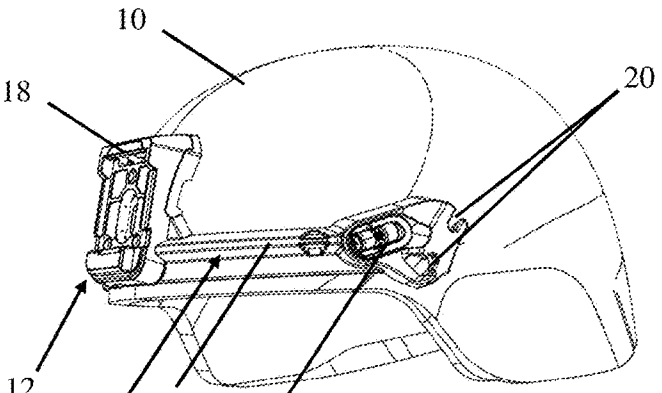
FIG. 3 is a schematic perspective view of the helmet shell and attachment system according to the embodiment of FIG. 1.

FIGS. 1-3 depict one embodiment of a helmet accessory mount assembly including a helmet shell 10 and an accessory such as a carrier 12 that is attached to the helmet. In the depicted embodiment, the carrier is a front mount system. Additionally, the carrier includes two opposing arms 14 structured to approximately match the contoured shape of the helmet, and which extend in opposite directions away from a central region of the carrier. The arms 14 include ridges 16 suitable to receive a portion of a corresponding portion of a system mounted to the helmet 10 such as, for example, front mount 18. The carrier may include any number of other connectors 20 which may be used for attaching accessories such as mandible guards.

As illustrated in the figures, the front of the carrier is attached to the two arms 14, which are attached to the sides of the helmet shell using attachment systems 100 located at the ends of the two opposing arms. While a particular number and arrangement of attachment points are depicted, it should be understood that the attachment points may be arranged on any suitable portion of the helmet shell and the carrier may be arranged in any desired fashion relative to the helmet shell. Additionally, any number of attachment points may be used. For example, a carrier may be attached to the helmet at a peripheral portion and/or a central portion of the helmet shell. In addition to the above, the arms of the carrier may be structured so as to provide for stability of a helmet accessory when mounted to the helmet. The arms of the carrier also may provide a number of points of attachment for other accessories.

Depending on the particular embodiment, it may be desirable for a carrier 12, or other accessory, to be at least partially supported by the helmet shell 10. In such an embodiment, the carrier 12, or other accessory, may be manufactured to have a shape and size that conforms to the contours of a particular helmet shell. For example, the carrier may be shaped such that upon attachment of the carrier to the helmet using the one or more attachment systems 100, one or more surfaces of the carrier and the helmet are held substantially flush with one another. It should be appreciated that, in some embodiments, the carrier may have surfaces that do not substantially conform to the corresponding one or more surfaces of the helmet.

Figure 4:
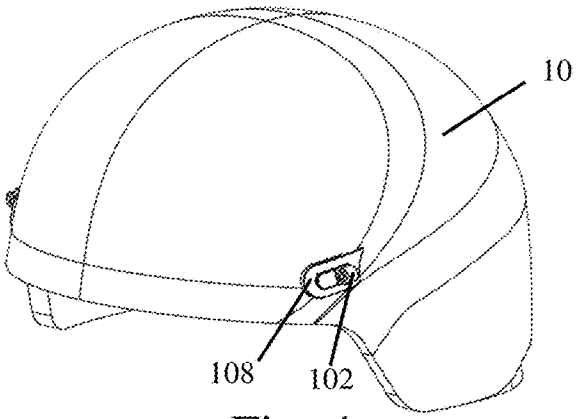
FIG. 4 is a schematic perspective view of the helmet shell and a first portion of the attachment system mounted to the helmet shell according to one embodiment.

FIG. 4 depicts a helmet shell 10 without an accessory attached thereto. A first attachment portion 102 of an attachment system is mounted to the helmet shell 10. As described above, the first attachment portion 102 protrudes from a base 108 such that it extends outwardly from the helmet shell. The base is mounted to the helmet shell in any suitable fashion as detailed above. Additionally, the base 108 has a shape that substantially conforms to a shape of the helmet shell 10 to aid in mounting the base to the helmet shell. However, embodiments in which the base 108 does not conform to a shape of the helmet shell are also contemplated.

Figure 5:
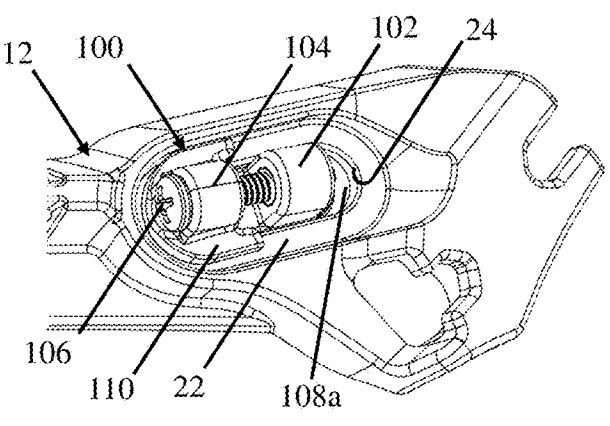
FIG. 5 is a schematic perspective view of an attachment system and an associated carrier according to one embodiment.

FIG. 5 illustrates an attachment system 100 and an associated carrier 12 in the attached state. The various components of the attachment system and carrier as well as their interactions are described in more detail below. For the sake of clarity, the underlying helmet shell is not depicted.

In the depicted embodiment, the attachment system includes a first attachment portion 102, a second attachment portion 104, and a connector 106. The connector 106 is a threaded bolt that extends through the second attachment portion 104 and forms a threaded connection with the first attachment portion 102. However, it should be understood that other connectors also may be used as described previously. The second attachment portion 104 includes a pair of wings 110 located on a lower section of the second attachment portion. The wings extend in opposing directions to provide an increased surface area facing the helmet shell 10.

The associated carrier 12 includes a recessed bearing surface 22 and an opening 24 extending from one side of the carrier to the other opposing side. The bearing surface extends around an entirety of the opening, though embodiments in which the bearing surface only extends around a portion of the opening are also contemplated. The opening 24 and associated bearing surface 22 are shaped as two superimposed elongated ovals. However, other shapes such as circles, squares, rectangles, or any other suitable shape also may be used. In addition, and as illustrated by the figure, the second attachment portion 104 is shaped and sized so to complement a shape and size of at least a section of the bearing surface 22. Specifically, the lower surface of the second attachment portion, e.g., the wings 110, fit within the recessed bearing surface 22. In some embodiments, the wings also may partially wrap around the first attachment portion 102 when the second attachment portion 104 is in contact with the first attachment portion 102. While a recessed bearing surface has been depicted, embodiments in which the bearing surface surrounding the opening is not recessed relative to another portion of the carrier are also contemplated. Additionally, in some embodiments, the bearing surface may not be located adjacent to the opening as the disclosure is not so limited.

As illustrated in FIG. 5, when the carrier 12 is positioned in the attached location on the helmet shell, the first attachment portion 102 extends through the opening 24 of the accessory. The second attachment portion 104 is subsequently engaged with the bearing surface 22 such that the bearing surface 22 of the carrier is located between the second attachment portion and the underlying helmet shell. Accordingly, the connection of the second attachment portion 104 to the first attachment portion prevents the opening 24 of the carrier from being removed from the first attachment portion 102 extending there through. In the depicted embodiment, the first attachment portion is initially positioned on at least a portion of the recessed bearing surface. A connector 106 is then passed through the second attachment portion 104 to form a threaded connection with the first attachment portion 102, though other types of connection are possible as noted above. As the connector is tightened, the second attachment portion may be displaced horizontally and/or vertically toward the first attachment portion to engage the bearing surface and attach the carrier to the helmet shell.

Figure 6:
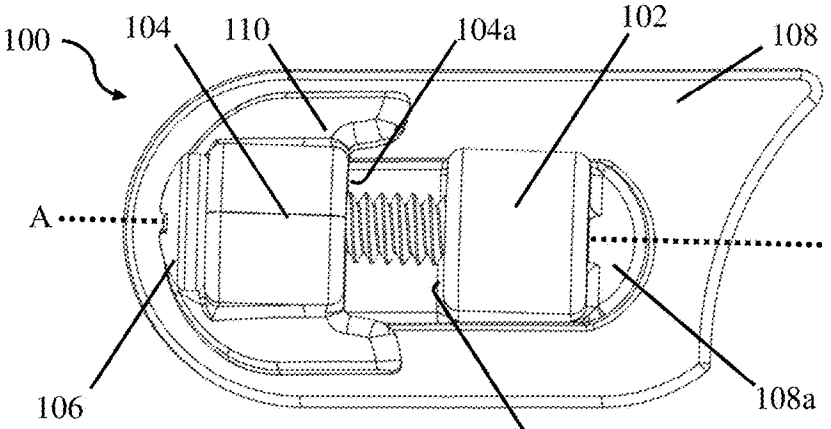
FIG. 6 is a schematic top view of the attachment system according to the embodiment of FIG. 5.
Figure 8:
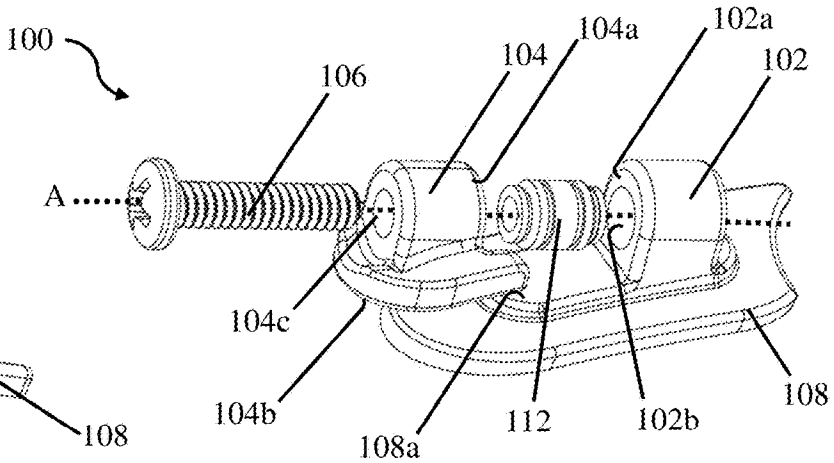
FIG. 8 is a schematic exploded view of the attachment system according to the embodiment of FIG. 5.
Figure 7:
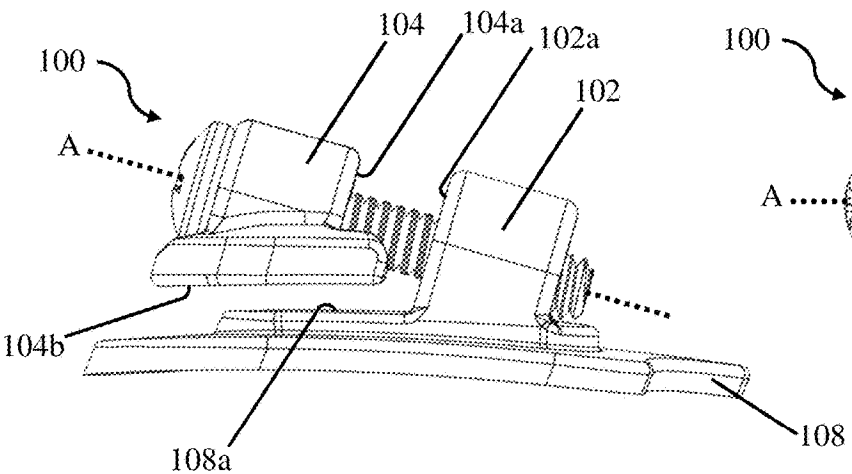
FIG. 7 is a schematic side view of the attachment system according to the embodiment of FIG. 5.

FIGS. 6-8 depict various components of the attachment system 100 and their interactions in more detail. Similar to the embodiments described above, the attachment system 100 includes: a first attachment portion 102 extending from a base 108; a second attachment portion 104 including a pair of wings 110 extending from opposing sides on a lower section of the second attachment portion located adjacent to an accessory; and a connector 106 that selectively connects the second attachment portion to the first attachment portion. As best depicted in FIG. 8 the first attachment portion 102 includes a threaded insert 112 that is assembled with the first attachment portion using an interference fit with the corresponding cavity or hole 102*b* formed in the first attachment portion. However, depending on the particular materials used, the threaded insert may be bonded with the first attachment portion or the threads may be integrally formed or cut into the first attachment portion as the disclosure is not so limited. When connected, the connector, which in the depicted embodiment is a threaded bolt, extends through a through hole 104*c* formed in the second attachment portion. The connector is then threaded into the threaded insert 112, or other suitable threaded portion, of the first attachment portion. As the connector 106 is tightened, the second attachment portion 104 is drawn toward the first attachment portion 102.

As best illustrated in FIG. 7, the connector 106, through hole 104*c*, and threaded insert 112 are oriented along an axis A. The axis A is oriented at an angle relative to the base 108 and/or the underlying helmet shell. The angle between the axis A and the base and/or helmet shell may be any suitable angle including, for example, approximately fifteen degrees. The angle may be greater than about five degrees and less than about 30 degrees in some embodiments, though any suitable angle may be used.

In some embodiments, it may be desirable to reduce the torque applied to the first and second attachment portions when the connector 106 is fully tightened. The two opposing surfaces 102*a* and 104*a* formed on the first and second attachment portions may be substantially perpendicular to the axis A. Without wishing to be bound by theory, by orienting these surfaces perpendicular to the axis along which the connector 106 applies its force, the stresses developed when surfaces 102*a* and 104*a* are in contact will be predominantly a normal stress as compared to a combination of normal and shear stresses. This control over the applied stress may help with the fatigue life of such an attachment system. However, embodiments in which the two opposing surfaces of the first and second attachment portions are not oriented perpendicularly to the connection axis are also contemplated.

Due to the connector being oriented at an angle, as the connector 106 is tightened, the second attachment portion 104 is displaced both vertically and horizontally toward the first attachment portion 102. In the depicted embodiment, the second attachment portion 104 would also be displaced vertically and horizontally toward the associated helmet shell that the first attachment portion is mounted to as well, not depicted. As the second attachment portion is displaced, a lower surface 104*b* of the second attachment portion that is facing the base 108 and/or helmet shell is also displaced in the same direction. While an attachment system where the second attachment portion is displaced toward both the first attachment portion and the helmet shell is described above, embodiments in which the second attachment portion 104 is displaced toward only one of the first attachment portion and/or helmet shell are also contemplated.

As best seen in FIG. 7, as the connector is tightened, a gap located between the lower surface of the second attachment portion and the helmet shell is reduced until the lower surface of the second attachment portion engages the bearing surface of the associated carrier. Depending on the particular embodiment and desired method of attaching an accessory to the helmet shell, the connector may be tightened until a desired normal force is generated between the lower surface 104*b*, or other suitable surface of the second attachment portion, and the bearing surface of the carrier. Alternatively, the lower surface 104*b*, or other suitable surface of the second attachment portion, may simply be positioned adjacent to the bearing surface of the carrier and the connector may be tightened until the second attachment portion is in contact with the first attachment portion.

As noted above, the second attachment portion 104 and its associated lower surface 104*b* are sized and shaped so that they can be engaged with a bearing surface of the associated carrier or other suitable substrate. Additionally, to facilitate engagement between them, the lower surface of the second attachment portion and the bearing surface of the carrier may be oriented at complementary angles relative to one another. For example, as illustrated in the figures, the bearing surface and the lower surface of the second attachment portion are both oriented parallel to the associated helmet shell surface. However, embodiments in which the surfaces are arranged at complimentary angles and are oriented at an angle relative to the helmet shell and/or other portions of the attachment system are also contemplated.

Figure 9:
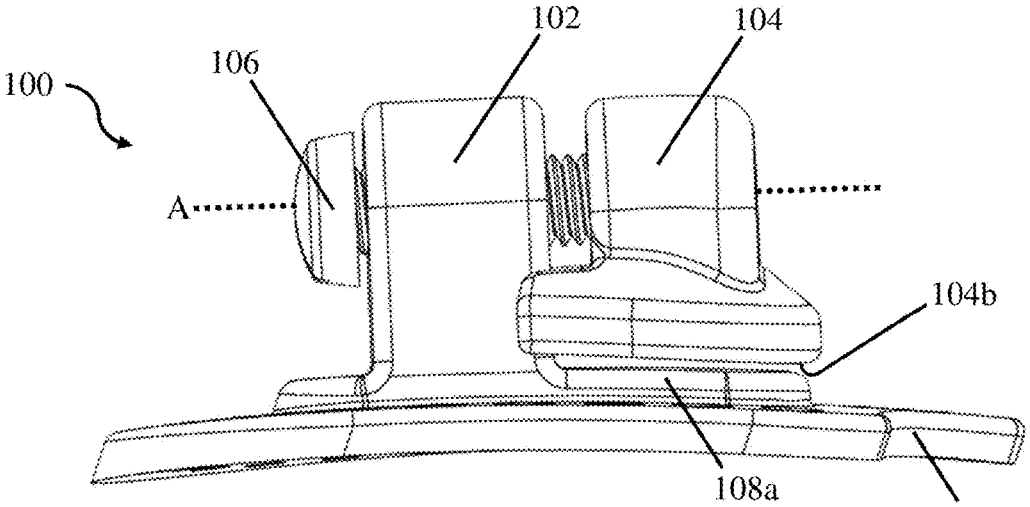
FIG. 9 is a schematic side view of an attachment system according to one embodiment.

While a connector that is angled relative to the base and/or helmet shell has been described above, in some embodiments a connector 106 and an associated axis A pass through the first and second attachment portions in an orientation that is parallel, i.e. oriented at an angle of 0° relative to the base 108 and/or helmet shell, as shown by way of example in FIG. 9. In such an embodiment, the second attachment portion 104 would only be horizontally displaced relative to the first attachment portion 102 and the associated helmet shell.

Referring again to FIGS. 6-8, depending on the particular embodiment, it may be desirable to limit or eliminate horizontal movement of the carrier, or other suitable accessory, relative to the helmet shell. Consequently, in some embodiments, the first attachment portion 102 may be associated with a locking feature such as a lock 108*a* that is arranged to interact with a feature on the corresponding accessory to help lock the accessory in a desired position on the helmet shell. The corresponding locks on the attachment system and accessory may be any suitable combination of features including, for example, pins and slots, interlocking shapes, keyed features, and/or any other suitable combination of features. In the specific embodiment depicted in the figures, the lock 108*a* corresponds to a protrusion extending from the base 108. The locking feature has a size and shape that complements a size and shape of the corresponding opening on the carrier, or other accessory. Consequently, when the carrier is attached to the helmet shell using the depicted attachment system, the lock 108*a* will extend into the opening 24 or other suitable feature on the carrier. Because the lock 108*a* has a size and shape that corresponds to the opening 24, the lock limits, or substantially eliminates, horizontal movement of the carrier relative to the helmet shell while it is attached thereto. While the figures depict a locking feature that is integrally formed with the first attachment portion, it should be understood that locking features that are separate from the first attachment portion also contemplated.

Figure 10:
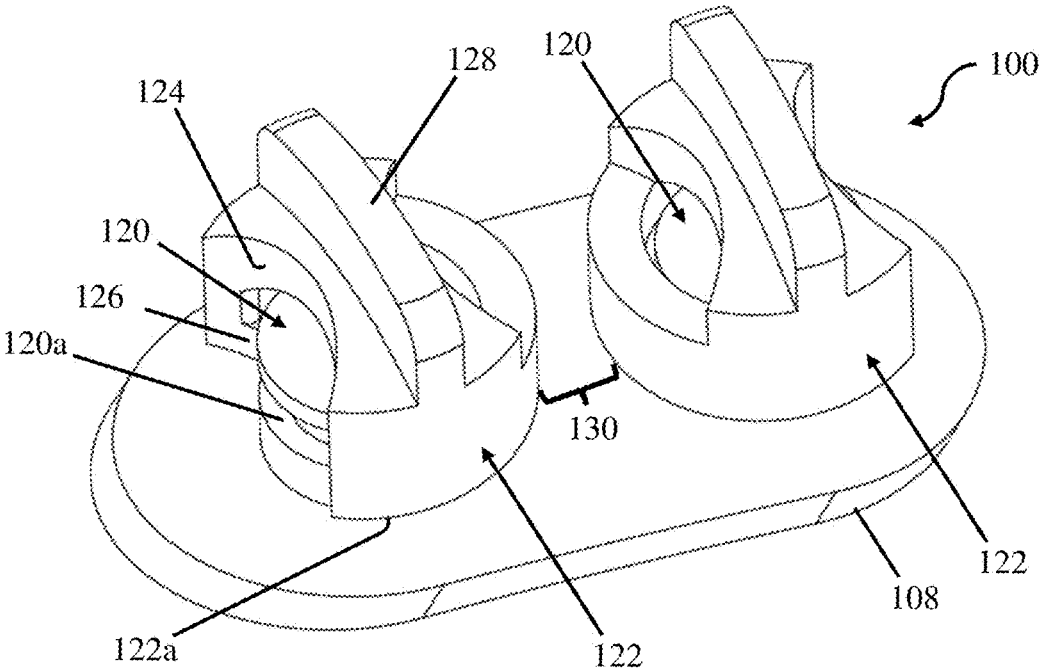
FIG. 10 is a schematic perspective view of an attachment system using pins and clips according to one embodiment.

FIG. 10 depicts another embodiment of an attachment system 100. In the depicted embodiment, the first attachment portion corresponds to a pin 120 protruding from a base 108. The pin 120 includes a slot 120*a* formed toward a distal end of the pin that extends around at least a portion of the circumference of the pin. Alternatively, as depicted in figure, the slot may extend around the entire circumference of the pin. The attachment system also includes a corresponding clip 122 sized and shaped to be selectively connectable to the pin. The clip includes an opening 124 located on a side of the clip. The clip also includes one or more retention features 126 that retain the clip on the pin one attached thereto. For example, as depicted in figure, the retention feature 126 corresponds to an inwardly extending shelf that interlocks with this slot 120*a* of the pin to prevent the clip from being vertically displaced off of the pin. To attach a clip 122 to a pin 120, the opening 124 is oriented toward the pin and the retention feature 126 is aligned with the slot 120*a*. The clip 122 is then displaced toward the pin 120. In the depicted embodiment, the opening located on a side of the clip is smaller than an outer diameter of the pin and the clip is made from a deformable material. Consequently, as the clip is pressed against a side of the pin the opening elastically deforms to around the pin prior to reclosing thus forming a snap fit with the pin. Once the clip is located on the pin, the retention feature and corresponding slot on the pin prevent the vertical removal of the clip. In addition to the above, a bottom surface 122*a* of the clip is spaced from the base 108 to be in contact with a bearing surface of a corresponding accessory located between the clip and helmet shell. Similar to the above embodiment, contact between the clip and the bearing surface of the corresponding accessory maintains the attachment between the accessory and the helmet shell. While a particular snap fit and retention feature have been described above, other types of snap fits and retention features also may be used.

Depending on the particular embodiment, it may be desirable to provide a grip 128 on the clip 122 to facilitate handling of the clip. In the depicted embodiment, the grip is a ridge that protrudes upwards from, and extends across the upper surface of, the clip. However, the grip may be located on other suitable portion of the clip and may have any desired shape and size. In one embodiment, the grip is shaped and sized to facilitate handling using a thumb and first finger of a user. However, the grip may be both smaller or larger than this as the disclosure is not so limited.

To increase a retention force provided by the attachment system, in some embodiments, multiple clip 122 and pin 120 combinations may be used as depicted in the figure. In addition to providing additional retention force, such an arrangement may be used to prevent unintended removal of the clips during use. For example, in some embodiments, a gap located between the outer surfaces of two adjacent clips located on two adjacent pins is selected to prevent their unintended removal from the pins when oriented in a locked orientation instead of an unlocked orientation. Specifically, in such an embodiment, after the clips are positioned on the pins, the grips128 are used to rotate each clip until a continuous side of the clip is facing the other clip. The gap between these two surfaces is less than the displacement necessary to remove the clips from the pins. Consequently, neither clip can be displaced off of its corresponding pin until its opening 124 is oriented in an unlocked direction pointed away from the other pin. This particular arrangement has been described with regards to two or more pin and clip combinations. However, this strategy to maintain a clip on an attachment system may also be used with a single pin and clip combination where a gap between the pin and clip combination and another feature on the attachment system and/or accessory is selected to prevent removal of the clip unless an opening of the clip is oriented in an suitable direction permitting displacement of the clip away from the corresponding feature and/or accessory.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An attachment system comprising:

a first attachment portion that is mountable to a helmet shell, wherein the first attachment portion includes a protrusion that extends through an opening through an accessory; and a second attachment portion that is selectively connectable to the protrusion of the first attachment portion extending through the opening of the accessory, wherein a surface of the second attachment portion that faces the helmet shell is engagable with a bearing surface of the accessory to selectively attach the accessory to the helmet shell when the second attachment portion is connected to the first attachment portion with the accessory disposed between the first attachment portion and the second attachment portion, and wherein the second attachment portion is moveable along an axis that is angled at a non-orthogonal angle relative to a surface of the underlying helmet shell when the first attachment portion is mounted thereto, and wherein the second attachment portion is moveable along the axis in a direction toward the protrusion of the first attachment portion.

2. The attachment system of claim 1, further comprising a connector that selectively connects the second attachment portion to the first attachment portion.

3. The attachment system of claim 2, wherein tightening the connector moves the second attachment portion both horizontally and vertically relative to the first attachment portion.

4. The attachment system of claim 1, further comprising the accessory.

5. The attachment system of claim 1, wherein the accessory comprises a front mount.

6. The attachment system of claim 1, further comprising the helmet shell.

7. The attachment system of claim 1, further comprising a lock constructed and arranged to maintain a position of the accessory relative to the helmet shell.

8. The attachment system of claim 7, further comprising the accessory, and wherein the lock comprises a protrusion that complements a size and shape of the opening of the accessory.

9. The attachment system of claim 4, where the accessory comprises a carrier that is attachable to a front of the helmet shell, the carrier including first and second arms which extend in opposite directions away from a central region of the carrier.

10. An attachment system comprising:

a first attachment portion that is mountable to a helmet shell;

a second attachment portion;

a connector that selectively connects the second attachment portion to the first attachment portion, wherein when the connector is tightened, the second attachment portion moves both vertically and horizontally relative to the first attachment portion and a surface of the underlying helmet shell when the first attachment portion is mounted thereto, and wherein the vertical and horizontal movement of the second attachment portion compresses a bearing surface of an accessory between a first surface of the first attachment portion and a second surface of the second attachment portion located opposite the first surface when the bearing surface is compressed therebetween to selectively attach the accessory to the helmet shell.

11. The attachment system of claim 10, further comprising the accessory.

12. The attachment system of claim 11, wherein the accessory comprises a front mount.

13. The attachment system of claim 10, wherein the accessory comprises a carrier configured to be attached to a front of the helmet shell, the carrier including first and second arms which extend in opposite directions away from a central region of the carrier.

14. The attachment system of claim 10, further comprising the helmet shell.

15. The attachment system of claim 10, further comprising a lock constructed and arranged to maintain a position of the accessory relative to the helmet shell.

16. The attachment system of claim 15, further comprising the accessory, and wherein the lock comprises a protrusion that complements a size and shape of an opening of the accessory.

17. The attachment system of claim 1, wherein the axis is angled at an angle between or equal to 5° and 30° relative to the surface of the underlying helmet shell when the first attachment portion is mounted thereto.

18. The attachment system of claim 1, wherein the surface of the second attachment portion that engages the bearing surface of the accessory maintains its orientation relative to the helmet shell while the second attachment portion is moved along the axis angled at a non-orthogonal angle relative to the helmet shell.

19. The attachment system of claim 18, wherein the surface of the second attachment portion that engages the bearing surface of the accessory is oriented parallel relative to the surface of the underlying helmet shell.

20. The attachment system of claim 10, wherein the second attachment portion includes a surface that faces the helmet shell and is engageable with a bearing surface of the accessory to selectively attach the accessory to the helmet shell when the second attachment portion is connected to the first attachment portion, and wherein the surface of the second attachment portion that engages the bearing surface of the accessory maintains its orientation relative to the helmet shell while the second attachment portion is moved along an axis angled at a non-orthogonal angle relative to the helmet shell.

21. The attachment system of claim 20, wherein the surface of the second attachment portion that engages the bearing surface of the accessory is oriented parallel relative to the surface of the underlying helmet shell.

22. The attachment system of claim 1, wherein the accessory is compressed between the first attachment portion and the second attachment portion.

23. The attachment system of claim 1, wherein the second attachment portion is displaceable towards the first attachment portion to engage the bearing surface of the accessory.

24. An attachment system comprising:

a first attachment portion that is mountable to a helmet shell, wherein the first attachment portion includes a protrusion that extends outward away from a surface of the underlying helmet shell;

a second attachment portion;

a threaded connector that extends between and selectively connects the second attachment portion to the protrusion of the first attachment portion, wherein the threaded connector is threaded into the protrusion of the first attachment portion and is oriented along an axis that is angled at a non-orthogonal angle relative to an underlying surface of the helmet shell, and wherein adjusting the threaded connector adjusts a spacing between the first and second attachment portions, and wherein an orientation of a surface of the second attachment portion facing the underlying surface of the helmet shell is maintained when the threaded connector is adjusted.

25. The attachment system of claim 24, wherein the surface of the second attachment portion facing the underlying surface of the helmet shell is parallel to the underlying surface of the helmet shell.

26. The attachment system of claim 24, wherein the axis of the threaded fastener is parallel to the underlying surface of the underlying helmet shell and the surface of the second attachment portion is not parallel to the underlying surface of the helmet shell.

27. The attachment system of claim 1, wherein a normal force applied to the bearing surface by the second attachment portion is oriented in a direction that is different from a direction of movement of the second attachment portion along the axis.

28. The attachment system of claim 10, wherein a normal force applied to the bearing surface by the second attachment portion to compress the bearing surface is oriented in a direction that is different from a direction of movement of the second attachment portion when the connector is tightened.

29. The attachment system of claim 24, wherein a normal force applied to a portion of an accessory compressed between the second attachment portion and the first attachment portion is oriented in a direction that is different from a direction of movement of the second attachment portion when the threaded connector is adjusted.

30. The attachment system of claim 19, wherein the surface of the second attachment portion remains parallel to the surface of the underlying helmet shell during movement of the second attachment portion.

31. The attachment system of claim 21, wherein the surface of the second attachment portion remains parallel to the surface of the underlying helmet shell during the vertical and horizontal movement of the second attachment portion.

32. The attachment system of claim 25, wherein the surface of the second attachment portion remains parallel to the surface of the underlying helmet shell during movement of the second attachment portion.

* * * * *